US006365827B1

(12) United States Patent
Schuchinsky et al.

(10) Patent No.: US 6,365,827 B1
(45) Date of Patent: Apr. 2, 2002

(54) CIRCULATOR CONDUCTOR ARRANGEMENT

(75) Inventors: Alexander Grigorievich Schuchinsky, Wellington; Gerald Leigh Therkleson, Wellington, both of (NZ)

(73) Assignee: Andrew Corporation, Orland Park, IL (US)

( * ) Notice: Subject to any disclaimer, the term of this patent is extended or adjusted under 35 U.S.C. 154(b) by 0 days.

(21) Appl. No.: 09/424,109

(22) PCT Filed: May 19, 1998

(86) PCT No.: PCT/NZ98/00062

§ 371 Date: Nov. 18, 1999

§ 102(e) Date: Nov. 18, 1999

(87) PCT Pub. No.: WO98/53519

PCT Pub. Date: Nov. 26, 1998

(30) Foreign Application Priority Data

May 19, 1997 (NZ) ..... 314841

(51) Int. Cl.[7] ..... H01B 11/12
(52) U.S. Cl. ..... 174/33; 333/1.1
(58) Field of Search ..... 174/32, 22; 333/1.1, 333/24.2, 238

(56) References Cited

U.S. PATENT DOCUMENTS

| | | | | |
|---|---|---|---|---|
| 3,334,318 A | * | 8/1967 | Nakahara et al. | 333/1.1 |
| 3,335,374 A | | 8/1967 | Konishi | 333/1.1 |
| 3,510,804 A | | 5/1970 | Hashimoto et al. | 333/1.1 |
| 3,761,842 A | * | 9/1973 | Gandrud | 333/1.1 |
| 4,246,552 A | | 1/1981 | Fukasawa et al. | 333/1.1 |
| 4,812,747 A | | 3/1989 | Kuramoto et al. | 333/1.1 |
| 5,498,999 A | * | 3/1996 | Marusawa et al. | 333/1.1 |
| 6,107,895 A | * | 8/2000 | Butland et al. | 333/1.1 |

FOREIGN PATENT DOCUMENTS

WO WO 97/39492 10/1997

OTHER PUBLICATIONS

Derwent Abstract Accession No.88–132266/19, Class W02, SU 1345276–A (Rost University) Oct. 15, 1977, Abstract.
International Search Report PCT/NZ98/00062, Aug. 10, 1998.

* cited by examiner

*Primary Examiner*—Chau N. Nguyen
(74) *Attorney, Agent, or Firm*—Merchant & Gould P.C.

(57) ABSTRACT

A conductor arrangement for a lumped element circulator in which the mutual inductive or capacitive coupling between conductors is different at different points of coupling between conductors. The conductors (11L, 11R, 12L, 12R, 13L, 13R) may taper from one end to another. The conductors (31L, 31R, 32L, 32R, 33L, 33R) may include tabs (34, 35, 36) at conductor cross overs. The conductors (41L, 41R, 42L, 42R, 43L, 43R) may include notches (44, 45, 46) at conductor cross overs. The conductors may include transitions (55) in the centrelines (54) of conductors (51L, 51R, 52L, 52R, 53L, 53R). The conductors (61L, 61R, 62L, 62R, 63L, 63R) may curvilinear. The conductors (11L–13R; 21L–23R; 31L–33R; 41L–43R; 51L–53R; 61L–63R) may converge.

21 Claims, 15 Drawing Sheets

PRIOR ART

CIRCULATOR CONDUCTOR ARRANGEMENT

The present invention relates to novel circulator conductor arrangement. U.S. Pat. No. 6,107,895 describes a circulator in which the conductor arrangement of the present invention may be employed, the disclosure of which is hereby incorporated.

Figure 1:
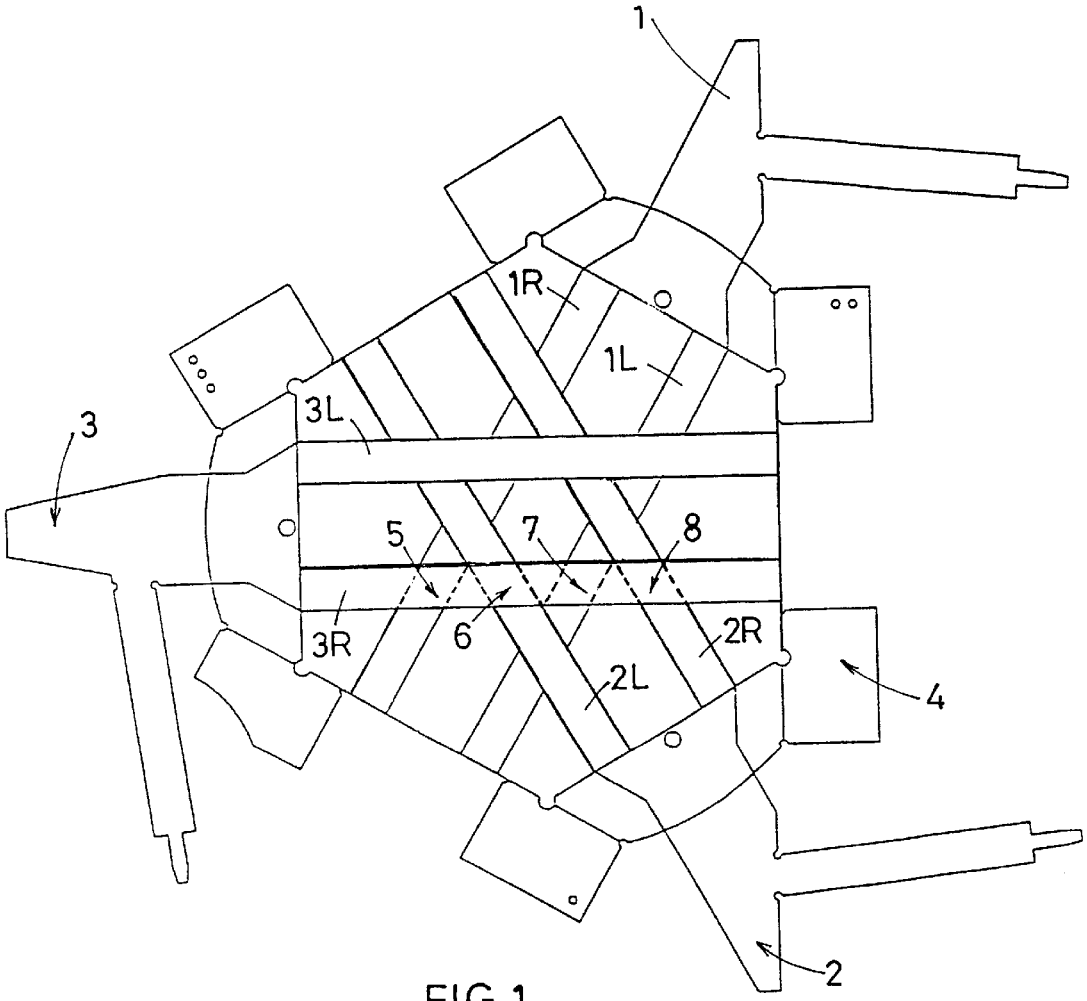

The topology of the conductor arrangement described in U.S. Pat. No. 6,107,895 is shown in FIG. 1. The conductor arrangement is seen to consist of conductors 1, 2 and 3 electrically connected at one end to base 4. Conductors 1, 2 and 3 include pairs of strip conductors 1L,1R;2L,2R and 3L,3R. The conductor arrangement shown in FIG. 1 is for a lumped element circulator. The coupling between strip conductors is largely dependent upon local interactions at strip conductor crossovers. The coupling between strip conductors at crossovers may be qualitatively modelled by considering only the coupling between overlapping portions of the strip conductors (as the fringing fields are incorporated into the model).

Figure 2:
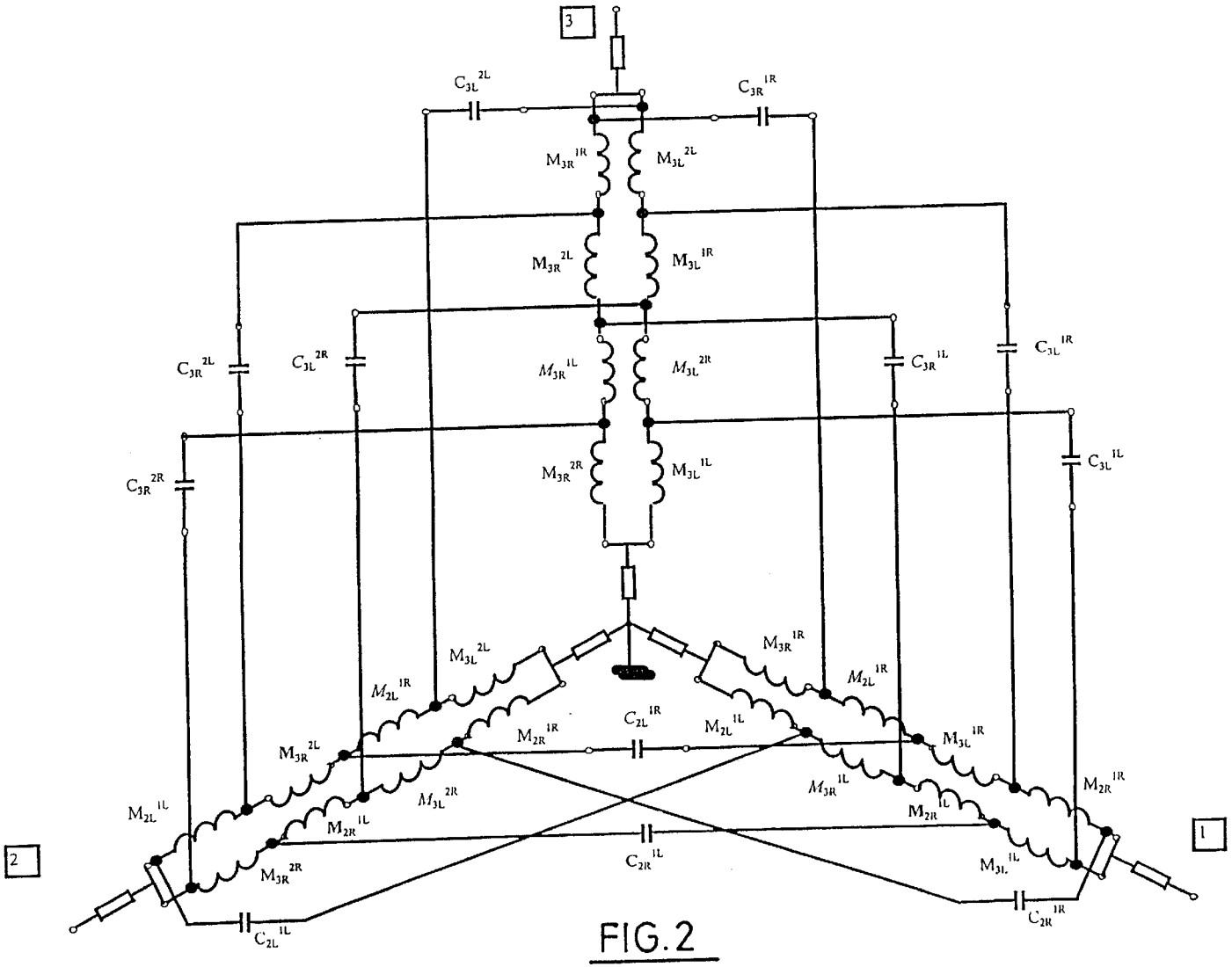

FIG. 2 shows an equivalent electrical circuit of the topology shown in FIG. 1 assuming that all coupling is confined between overlapping portions of the strip conductors only. Region 5 shown in FIG. 1 corresponds to the couplings $M_{3R}^{1R}$ and $C_{3R}^{1R}$ shown in the equivalent circuit in FIG. 2. The region 6 indicated in FIG. 1 corresponds to couplings $M_{3R}^{2L}$ and $C_{3R}^{2L}$. Likewise regions 7 and 8 correspond to couplings $M_{3R}^{1L}$ and $C_{3R}^{1L}$; and $M_{3R}^{2R}$ and $C_{3R}^{2R}$ shown in FIG. 2. The remaining equivalent values can be easily deduced in a similar manner (i.e. M indicates inductive coupling, C indicates capacitive coupling and 1L, 1R, 2L, 2R and 3L, 3R indicate the crossing strip conductors referred to in FIG. 1).

It will be appreciated that due to the symmetry of the topology shown in FIG. 1 the areas of regions 5, 6, 7 and 8 etc are substantially the same and the angles of crossing strip conductors 1L, 1R, 2L, 2R and 3L, 3R to each other are substantially the same.

In the model described above it has been assumed that the mutual capacitance and inductance between strip conductors is defined only by the coupling between overlapping areas.

It will be appreciated that the mutual capacitance between strip conductors is dependent upon the overlapping area of the strip conductors and the distance between strip conductors. It will also be appreciated that the mutual inductive coupling is dependent upon the angle at which the strip conductors are disposed to one another.

For the arrangement shown in FIG. 1 it will be appreciated that the mutual capacitive and inductive coupling between strip conductors is substantially the same in each region (5, 6, 7, 8 etc) as the overlapping areas and angles of disposition of the crossing strip conductors remain substantially the same.

It would be desirable to alter the mutual inductive and capacitive couplings illustrated in FIG. 2 somewhat independently to assist in optimising phase balance and the amount of coupling between ports. This would improve transmission and impedance matching and isolation between circulator ports.

U.S. Pat. No. 4,246,552 discloses a circulator having v-shaped strip conductors in which pairs of strip conductors converge from the outer edge of the conductor arrangement to join towards the centre thereof. The preferred range of the convergence angle of the pairs of strip conductors is 15–25°. This means that the strip conductors,of a pair join over a central region of the ferrite, which may adversely affect impedance matching with output ports of the circulator. In this arrangement narrow strip conductors are used and the aim is to increase distributed magnetic coupling between strip conductors. The arrangement is such that 3 conductors cross at conductor crossovers, which prevents substantially independent variation of the coupling between selected pairs of conductors.

It is an object of the present invention to provide circulator conductor arrangements allowing more independent alteration of inductive and capacitive coupling at strip conductor crossovers or to at least provide the public with a useful choice.

According to a first aspect of the invention there is provided a conductor arrangement for a lumped element circulator including a plurality of crossing over strip conductors providing substantially different amounts of coupling between strip conductors at selected individual crossovers, wherein the local width of one or more strip conductor varies between selected cross-overs to provide different lumped coupling at selected cross-overs and alter the ratio between capacitive and inductive couplings.

According to another aspect of the invention there is provided a conductor arrangement for a lumped element circulator including a plurality of crossing over strip conductors providing substantially different amounts of local coupling between portions of strip conductors at selected cross-overs, wherein the centrelines of each pair of strip conductors are disposed to each other at an angle of less than 10°.

According to another aspect of the invention there is provided a conductor arrangement for a lumped element circulator including a plurality of crossing over strip conductors providing substantially different amounts of local coupling between strip conductors at selected cross-overs, wherein at least one strip conductor has a transition along its centre line to provide different local lumped coupling at selected cross-overs.

According to a further aspect of the invention there is provided a conductor arrangement for a lumped element circulator including a plurality of crossing over strip conductors providing substantially different amounts of coupling between strip conductors at selected cross-overs, wherein the centre lines of the strip conductors follow curvilinear paths and the arrangement is such as to provide different local lumped coupling at selected cross-overs.

Preferably each conductor comprises a pair of strip conductors. The strip conductors are preferably arranged in an overlying spaced apart crossing arrangement.

According to one aspect of the invention the width of one or more strip conductor varies along the length of the strip conductor. The width of a strip conductor may taper from one end of the strip conductor to the other. Preferably all conductors taper in the same manner. Preferably the angle of taper is less than 10° from the centre line of the conductor to an outside edge of a conductor, more preferably the angle of taper is less than 5° and more preferably less than 2°.

The variation of width of strip conductors is preferably identical for each pair of strip conductors.

According to another aspect of the invention the centre lines of each pair of strip conductors are non-parallel. The centre lines of pairs of strip conductors may converge. Preferably the angle of convergence of the centre lines is less than 20°, more preferably less than 10°, more preferably less than 6°. Alternatively, there may be transitions between portions of strip conductors. Alternatively the centre lines of pairs of strip conductors may follow curvilinear paths.

According to another aspect, tabs may be provided at regions where a strip conductor overlaps with one or more other strip conductor, or notches may be provided in a strip conductor where the strip conductor overlaps with other strip conductors.

According to a further aspect the distance between strip conductors may vary for different crossings of strip conductors.

The invention will now be described by way of example with reference to the accompanying drawings in which:

FIG. 1: shows a conductor topology comprising parallel strip conductors of constant width.

FIG. 2: shows an equivalent electrical circuit for the conductor topology of FIG. 1.

Figure 3:
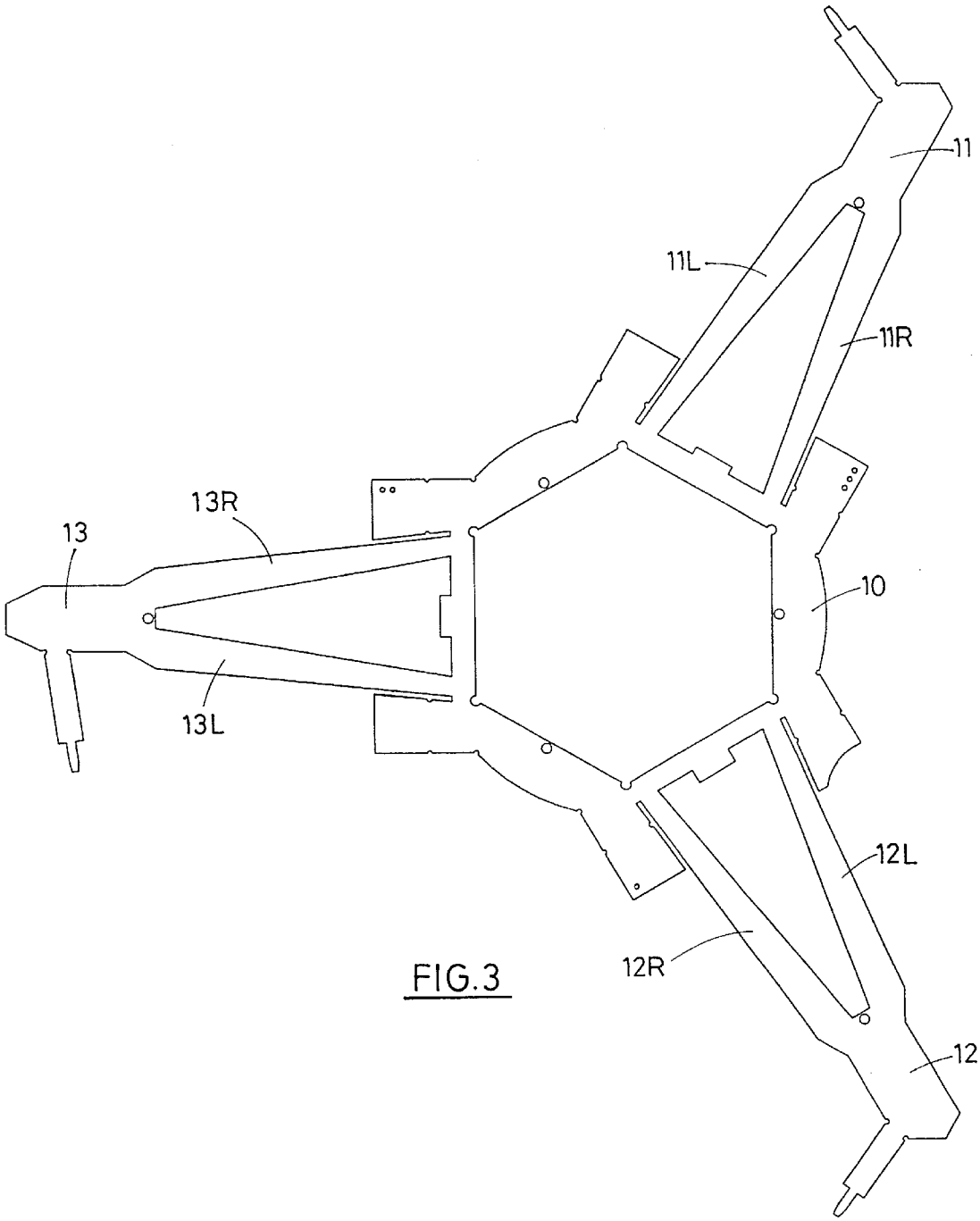

FIG. 3: shows an unfolded conductor topology having tapering and converging strip conductors.

Figure 4:
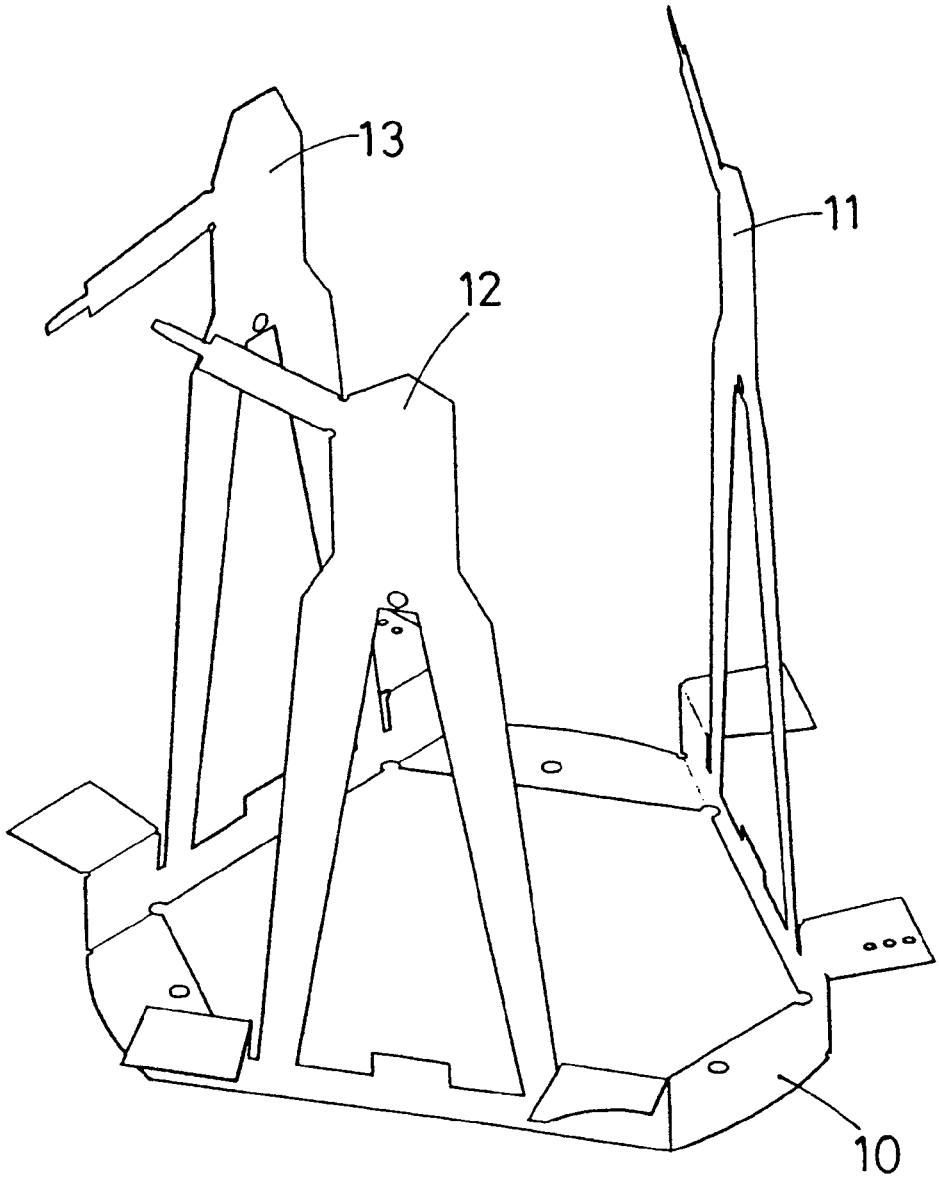

FIG. 4: shows the conductor topology of FIG. 3 partially folded.

Figure 5:
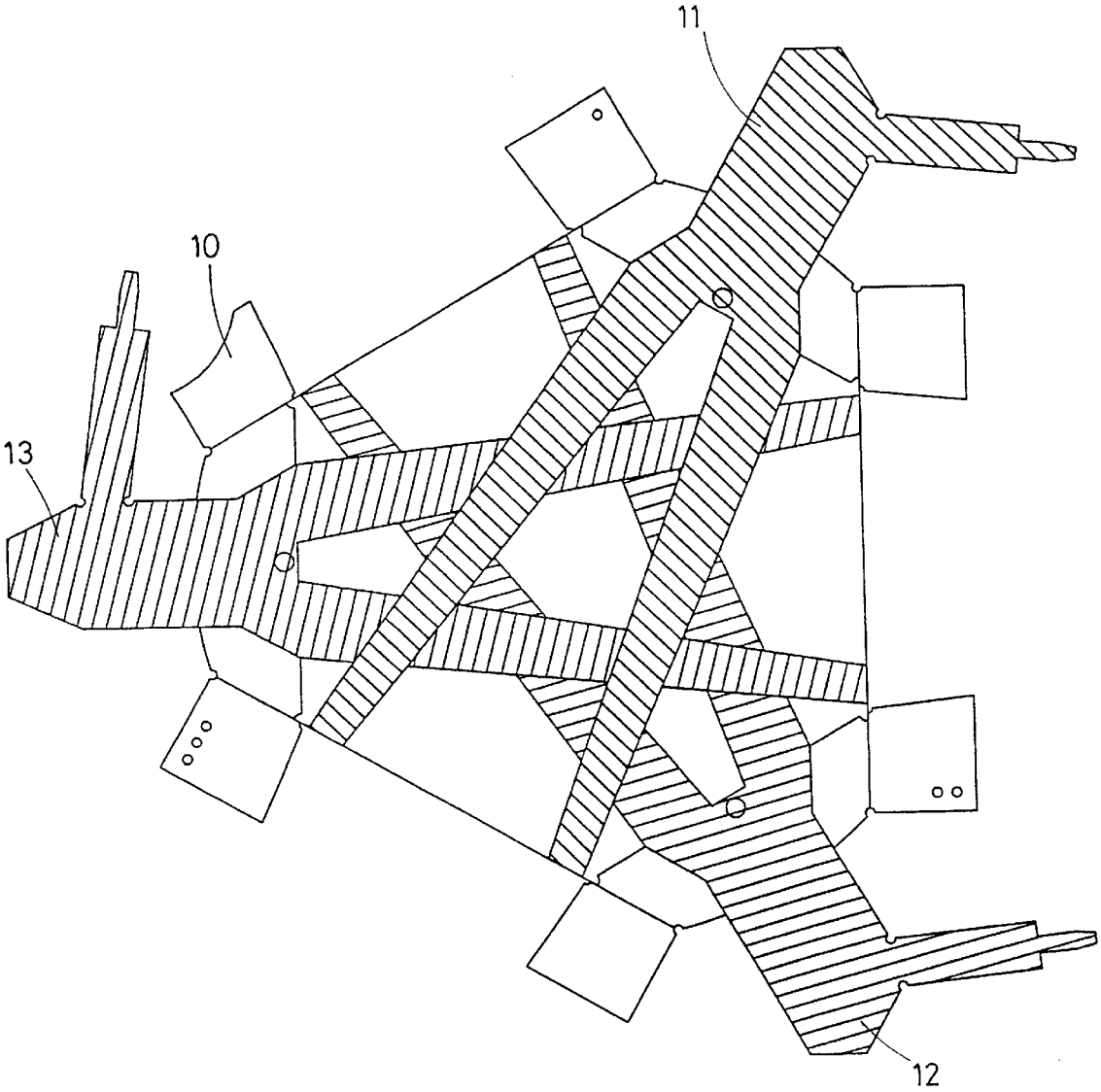

FIG. 5: shows the conductor topology of FIG. 3 folded to its "in use" configuration.

Figure 6:
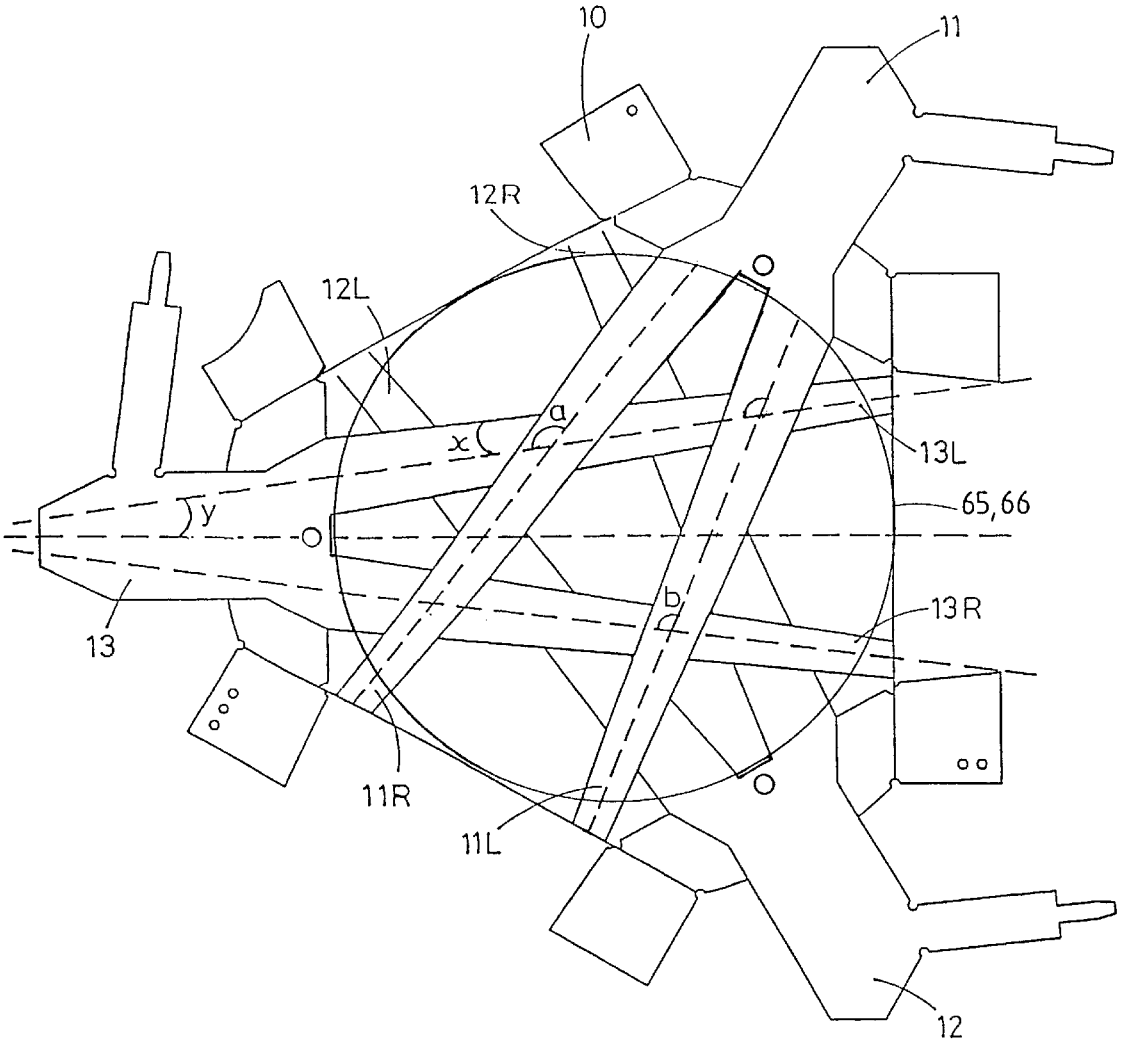

FIG. 6: shows the angles of taper and convergence of the strip conductors of the topology shown in FIG. 5.

Figure 7A:
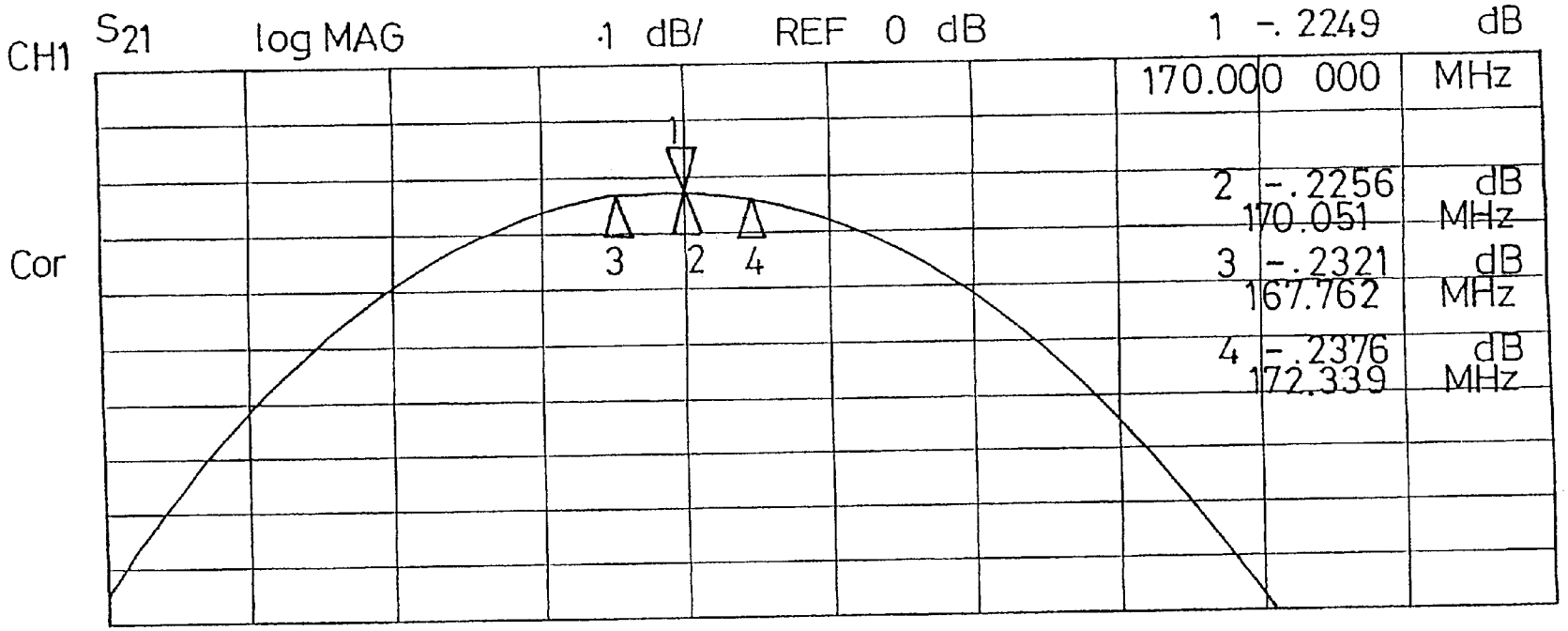
Figure 7B:
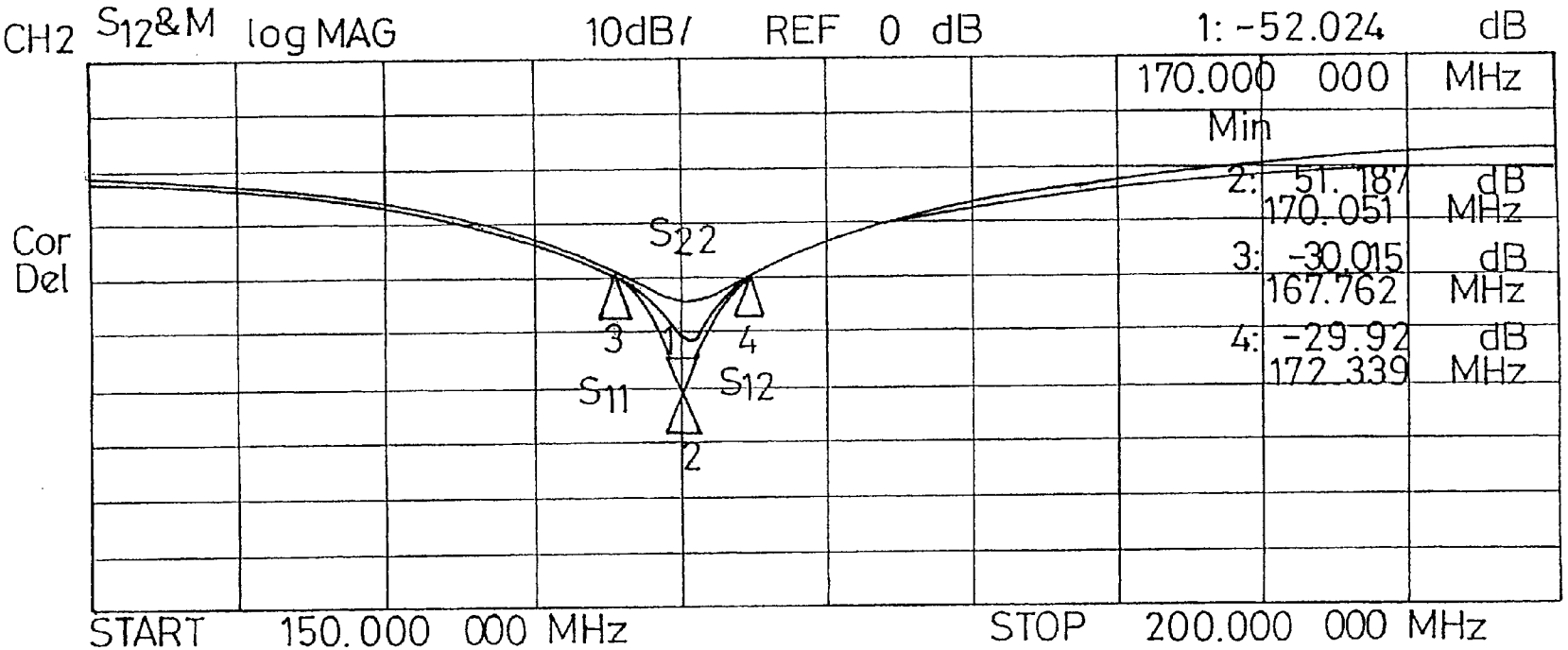

FIGS. 7*a* and 7*b*: illustrates the improved performance of a circulator using the conductor topology of FIG. 5.

Figure 8:
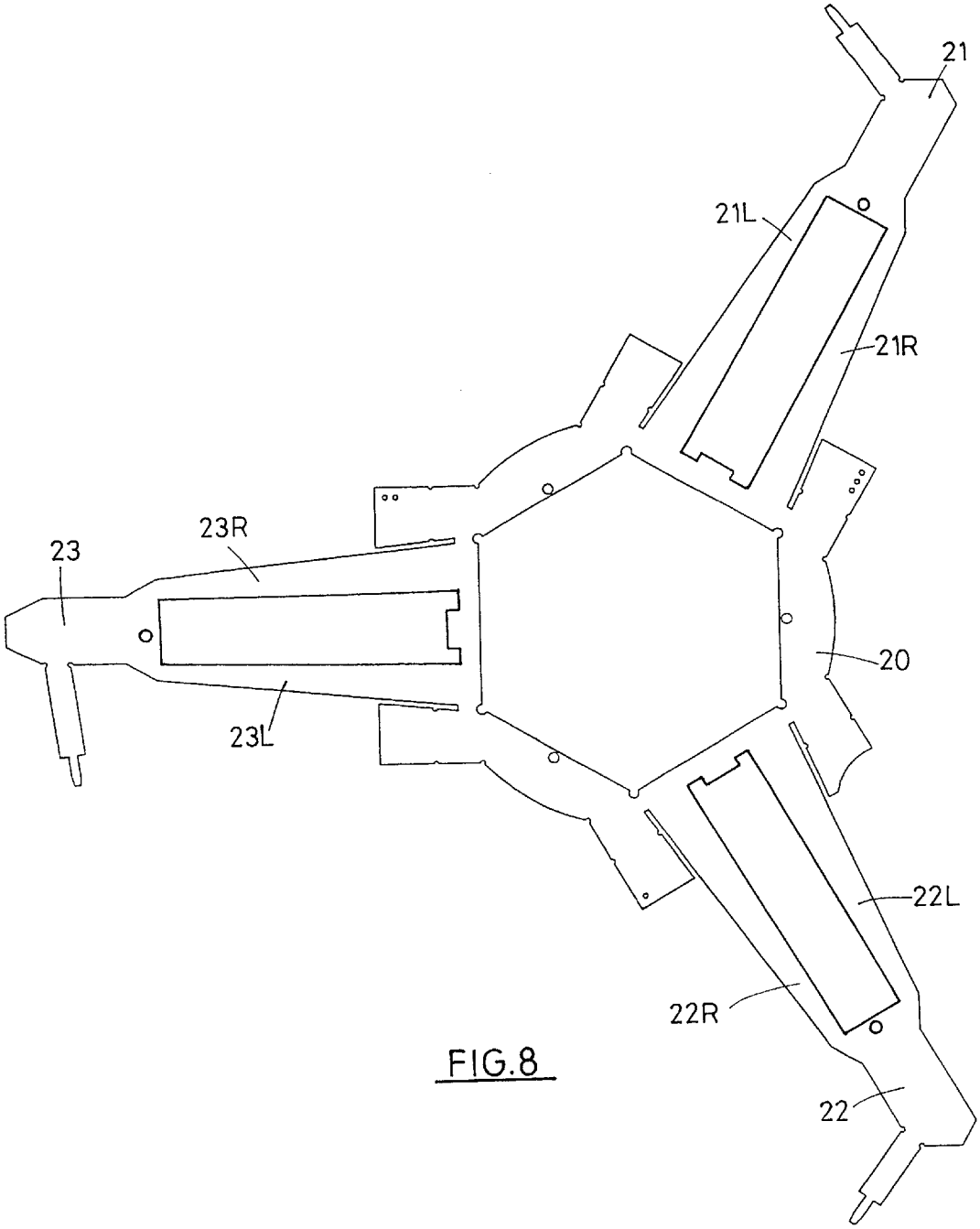

FIG. 8: shows an unfolded conductor topology in which the strip conductors taper in the opposite direction to that shown in FIG. 3.

Figure 9:
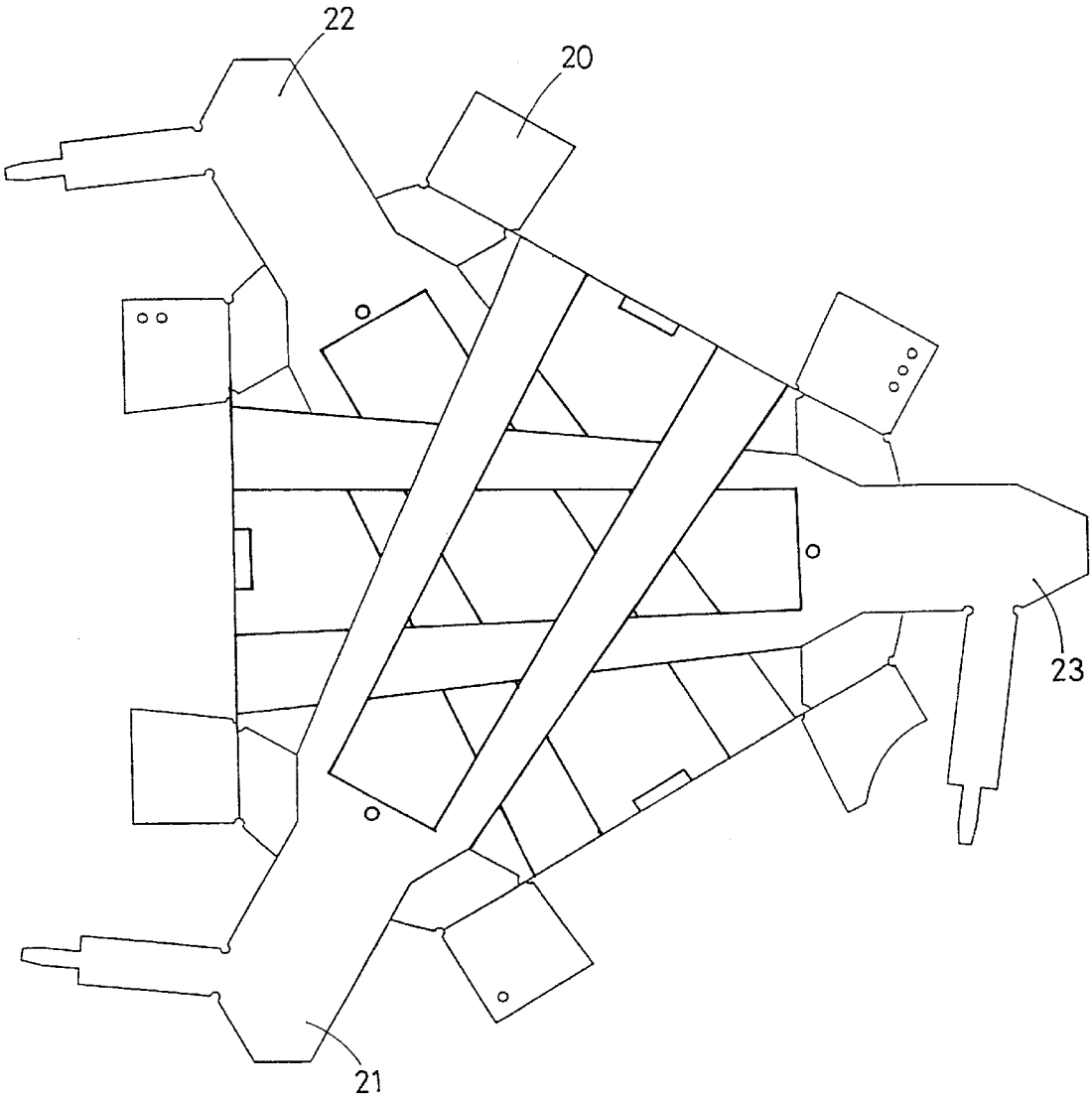

FIG. 9: shows the conductor topology of FIG. 8 when folded to the "in use" configuration.

Figure 10:
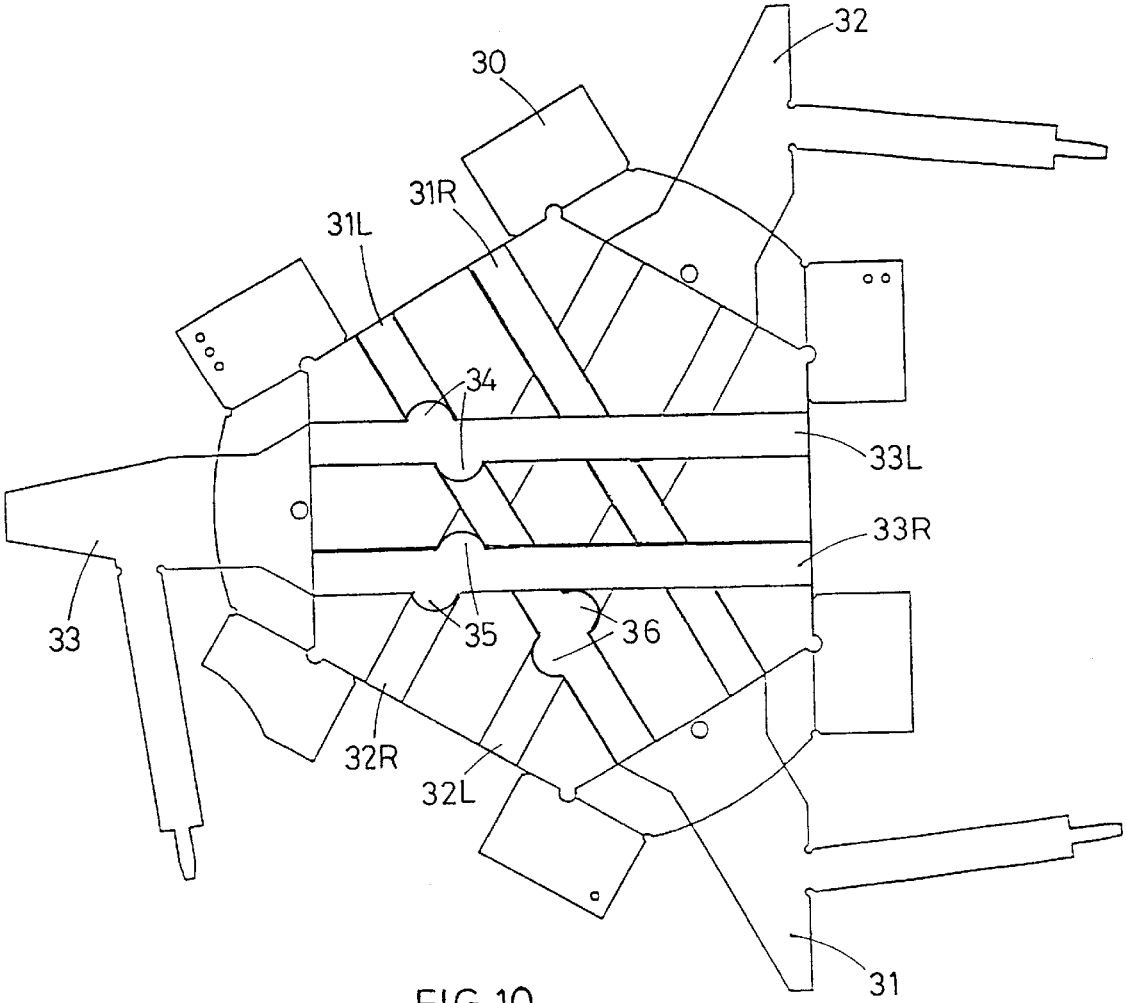

FIG. 10: shows a conductor topology incorporating tabs on the strip conductors.

Figure 11:
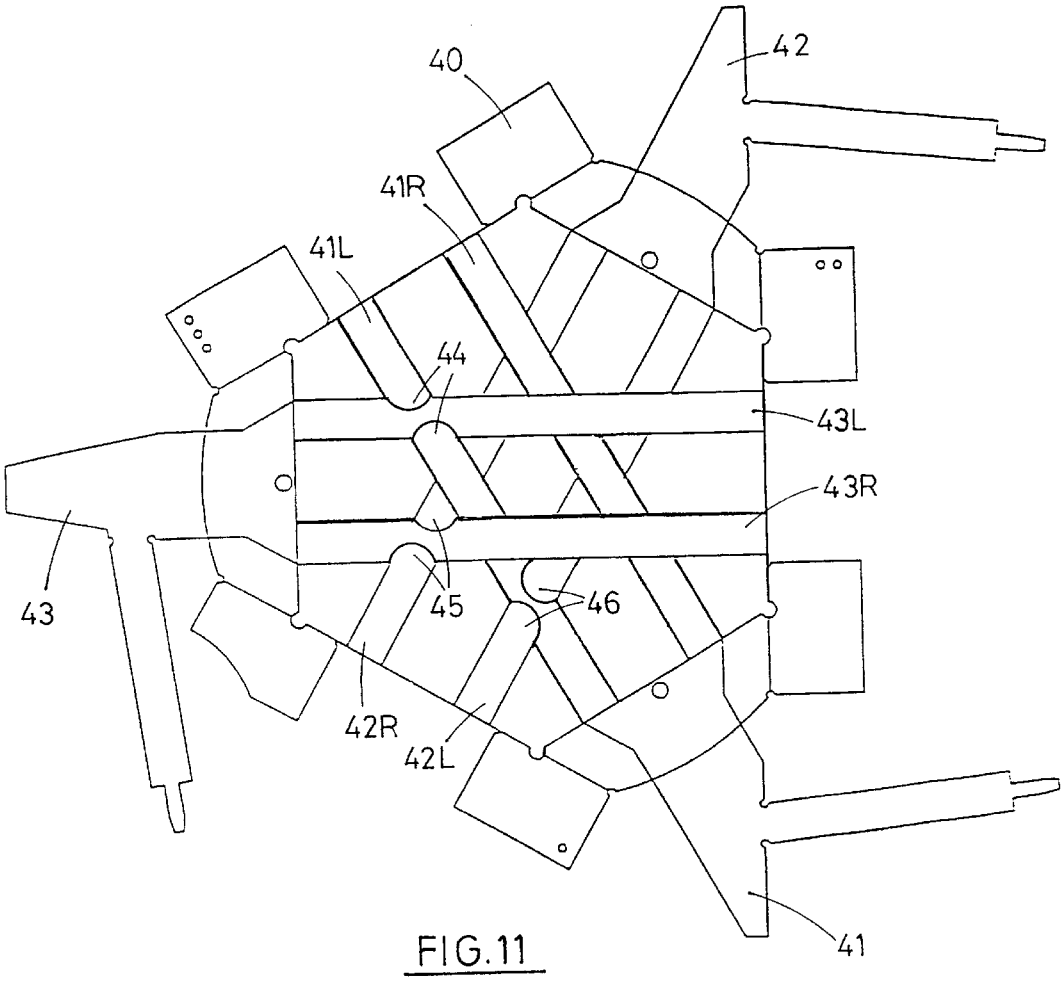

FIG. 11: shows a conductor topology incorporating notches in the strip conductors.

Figure 12:
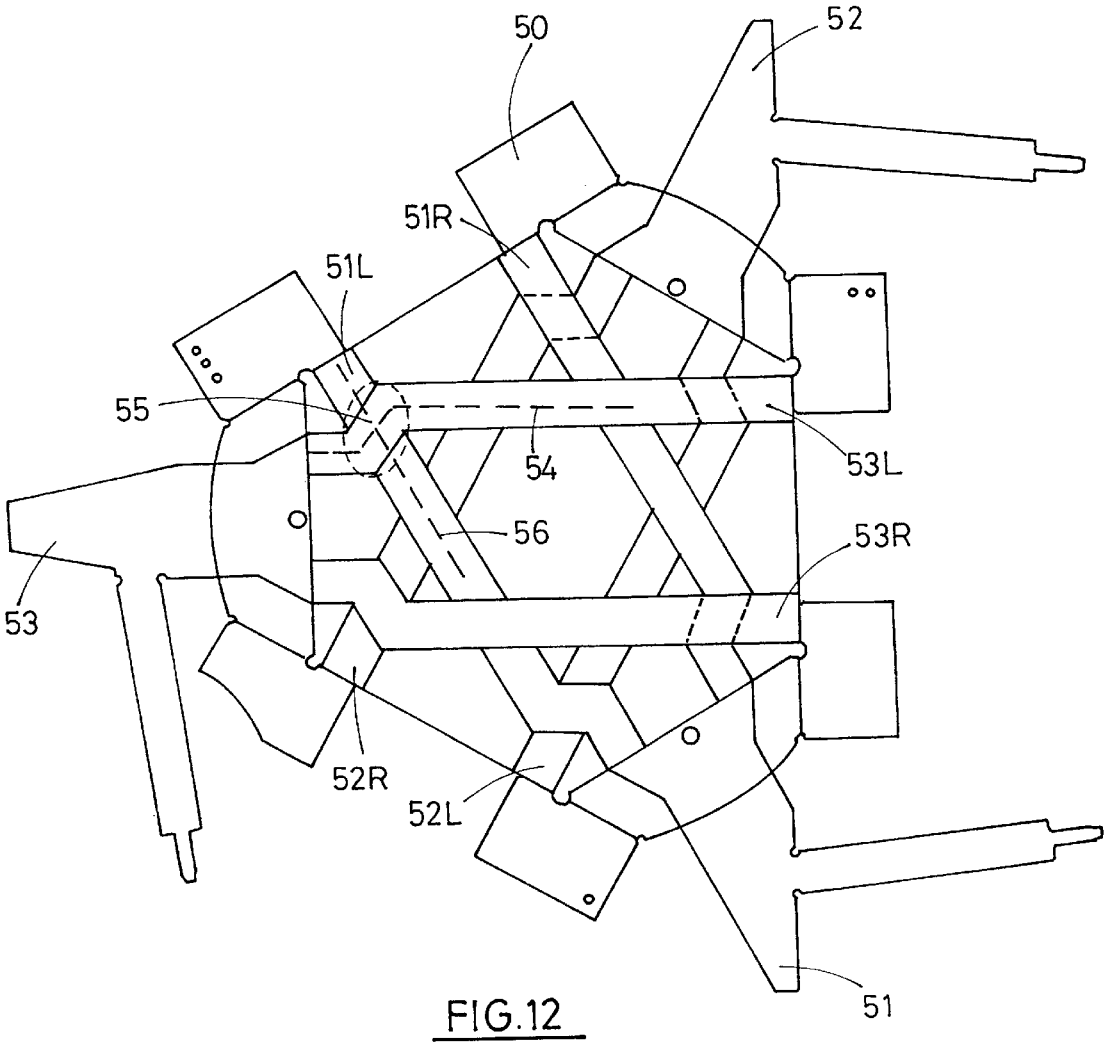

FIG. 12: shows a conductor topology in which the centre lines of the conductors follow a non linear (stepped) path.

Figure 13:
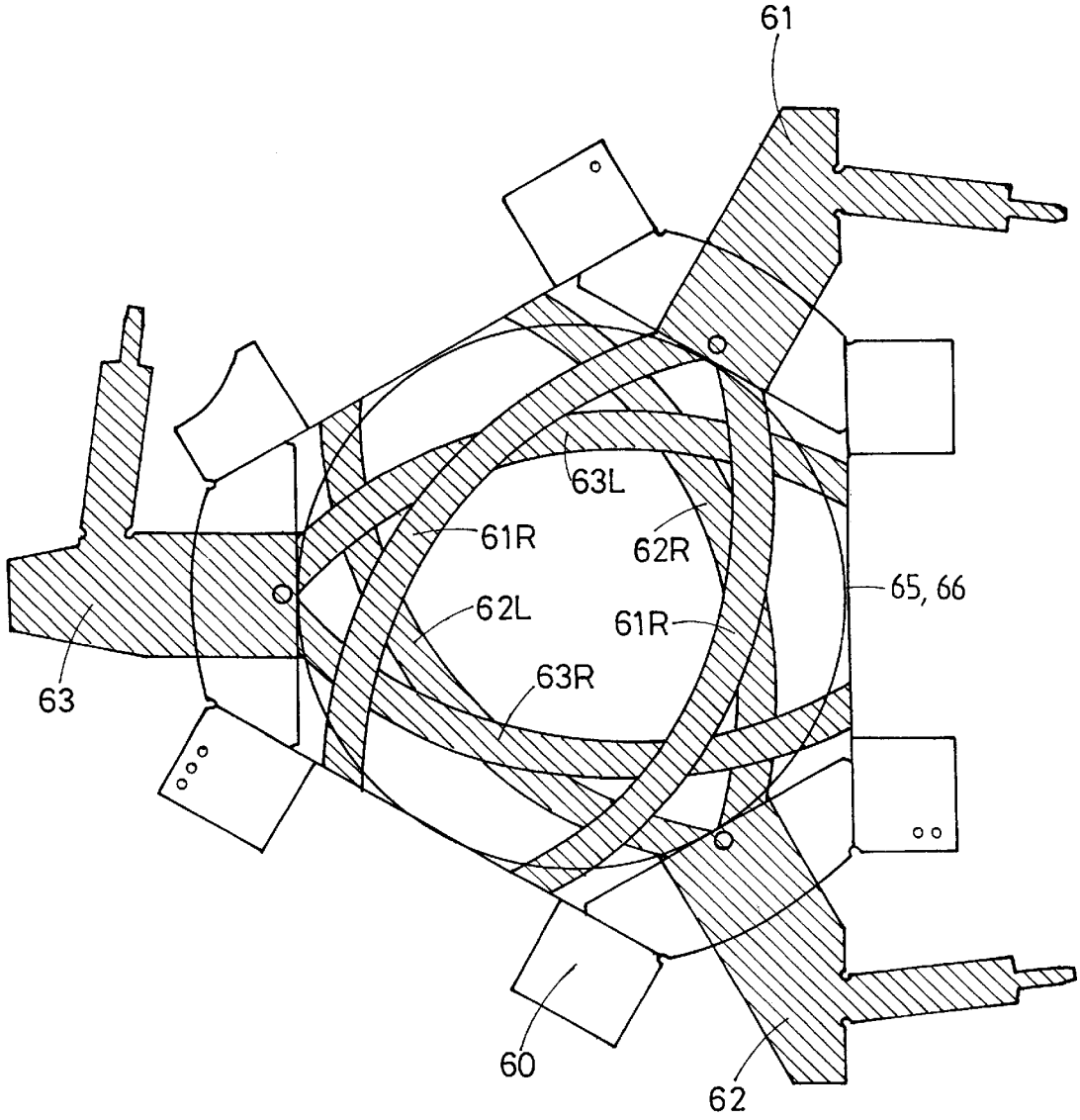

FIG. 13: shows a conductor topology in which the centre lines follow a curvilinear path.

Figure 14:
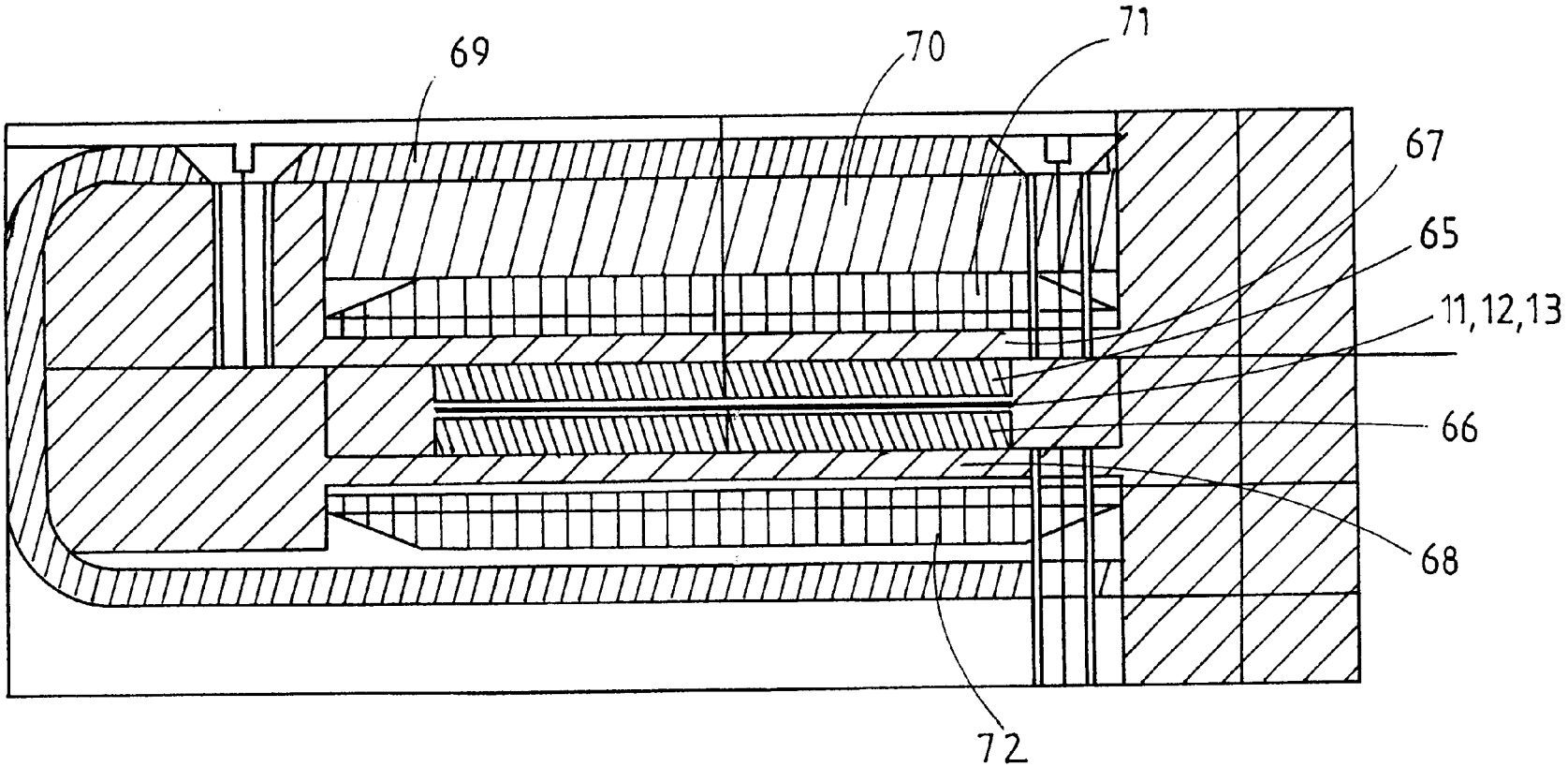

FIG. 14: shows a side cross-sectional view of a circulator including the conductor arrangement of FIGS. 3–6 and 8–13.

FIGS. 3 to 6 show a conductor arrangement suitable for use in a circulator of the type described in U.S. Pat. No. 6,107,895. It will, however, be appreciated that the conductor assemblies of the present invention may be utilised in circulators of other constructions also.

FIG. 3 shows the topology of the conductor arrangement when formed from a sheet of metal or other suitable conducting material by stamping, etching etc. The conductor arrangement comprises conductors 11, 12 and 13 connected to base portion 10. Each conductor 11, 12 and 13 includes a pair of strip conductors 11L, 11R; 12L, 12R and 13L, 13R.

FIG. 4 shows the conductor arrangement of FIG. 3 when conductors 11, 12 and 13 have been folded inwardly through 90° with respect to base 10.

FIG. 5 shows the conductor arrangement when conductors 11, 12 and 13 have sequentially been folded inwardly through a further 90° from the position shown in FIG. 4. It will be seen in FIG. 6 that strip conductors 11L, 11R, 12L, 12R, 13L and 13R taper in width from one end to another. The angle of taper between the centre lines of strip conductor 13L and an outer edge is denoted by the symbol "x". It will also be noted that the centre lines of the strip conductors converge. The angle of convergence between the centre line of strip conductor 13L and a centre line between strip conductors 13L and 13R is denoted by the symbol "y". The angle of convergence between the centre lines of strip conductors 13L and 13R is obviously 2*y*.

Due to the convergence of the strip conductors, it is apparent that the angles between the centre lines of crossing strip conductors vary at different strip conductor crossings. For example, the angle "a" between the centre lines of strip conductors 11R and 13L is clearly greater than the angle "b" between the centre lines of strip conductors 11L and 13R.

Accordingly, the inductive coupling between lines 11R and 13L is greater than the inductive coupling between lines 11L and 13R. Further, it is clearly apparent that the overlapping area between strip conductors 11R and 13L is greater than the overlapping area between strip conductors 11L and 13R. Accordingly, the mutual capacitive coupling of the former would be greater than that of the latter. The pairs of strip conductors join at their distal ends at a location beyond the edges of the area containing the ferrite to provide proper impedance matching with output ports.

A typical circulator of the type described in U.S. Pat. No. 6,107,895 is shown in FIG. 14. Conductors 11, 12, 13 connected to terminal ports are sandwiched between ferrite blocks 65 and 66. Silver plated aluminium or copper layers 67 and 68 are an integral part of the circulator housing body which act as ground planes and assist in effective heat transfer from ferrite blocks 65 and 66. U shaped yoke 69 provides an easy path for the magnetic flux from permanent magnet 70 to ferrite blocks 65 and 66. Magnetic lens 71 is located adjacent to disk-shaped permanent magnet 70. A similar lens 72 is provided on the opposite side of the magnetic circuit. This means that the magnetic circuit effectively concentrates the magnetic field and enhances the uniformity of the internal magnetic field inside the ferrite blocks 65, 66. The ferrite blocks 65, 66 are also shown in FIGS. 6 and 13.

It will be appreciated that the equivalent electrical circuit shown in FIG. 2 is applicable to the topology shown in FIG. 6 if the numeral 1 is replaced with 11, the numeral 2 is replaced with the numeral 12 and the numeral 3 is replaced with the numeral 13.

It will be appreciated that in the equivalent electrical circuit shown in FIG. 2, for the topology shown in FIG. 6, the values of mutual capacitive and inductive coupling will vary for the various crossings depending upon the overlapping area between strip conductors and the angles at which strip conductors are disposed to one another. By varying the topology of the conductor arrangement the mutual capacitive and inductive couplings can be altered somewhat independently to assist in optimising phase balance and coupling between circulator ports.

This conductor arrangement topology concentrates conductor crossovers with stronger magnetic coupling towards the centre of adjacent ferrite disks. As the magnetic field is most homogenous towards the centre this results in reduced insertion loss. At the same time the crossovers of the conductors are spread over a larger surface of the ferrites, thus providing more uniform power distribution across the volume of the ferrites.

Referring now to FIGS. 7*a* and 7*b* the characteristics of the circulator containing the conductor arrangement topology shown in FIG. 6 are displayed. The improvement in performance of the latter configuration over the topology shown in FIG. 1 was in better matching (higher return loss $S_{11}$ and $S_{22}$ shown in FIG. 7*b*) and less insertion loss ($S_{21}$ shown in FIG. 7*a*). These improvements may be attributed to alteration of the ratio of inductive and capacitive coupling by tapering the strips and slots between them.

Referring now to FIG. 8 an alternative topology is shown in which the direction of taper of the strip conductors 21L, 21R, 22L, 22R, 23L and 23R is in the opposite direction.

FIG. 9 shows the topology of FIG. 8 when folded to the "in-use" position (in the manner previously described). This topology provides increased inductive coupling in comparison with the topology of FIGS. 3–6.

Referring now to FIG. 10 an alternative embodiment is shown in which tabs 34, 35 and 36 are provided on strip conductors 33L, 33R and 31L. Similar tabs are provided on strip conductors 32R, 32L and 31R but these are obscured by the overlaying strip conductors.

Tabs 34, 35 and 36 provide additional capacitive coupling between strip conductors 33L and 31L, 33R and 32R and 31L and 32L. The size of tabs 34, 35, 36 can be varied depending upon the amount of mutual capacitive coupling desired between respective strip conductors. Although the tabs are shown in FIG. 10 as being semi-circular it will be appreciated that a variety of shapes may be employed and the important factor is the size of the overlapping area of conductors at crossover. It may, however, be desirable to avoid the tabs extending so as to overlap with conductors other than the crossing pair. Accordingly, tabs 34, 35 and 36 may be dimensioned so as to avoid overlapping with a further conductor.

Referring now to FIG. 11 an alternative embodiment is shown in which notches 44, 45 and 46 are provided in strip conductors 43L, 43R and 41L to reduce the overlapping area between conductors at crossings. This reduces the mutual capacitive coupling and increases inductive coupling between strip conductors at the crossings where the notches are located. In the embodiments shown in FIG. 11 notches are provided in strip conductors 41R, 42R and 42L but these cannot be seen due to the overlaying conductors 43R, 41R and 43L. It will be appreciated that notches 44, 45 and 46 may be a variety of shapes.

Referring now to FIG. 12 a conductor arrangement is shown in which the centre lines of the strip conductors are not straight lines. For example, in the encircled region indicated by the arrow 55, the centre line of strip conductor 53L undergoes a step transition from one portion to another. At this transition it will be appreciated that the angle of the centre line 54 to centre line 56 of strip conductor 51L is different to what it would have been had the centre line been straight along its entire length (as in the embodiment shown in FIG. 1). The change in direction of the centre line in region 55 results in a change in the inductive coupling between lines 53L and 51L. It will be appreciated that changing the angle at which a strip conductor crosses another strip conductor can be used to vary the mutual inductive coupling as desired. This technique may be used at one or more location along the length of a strip conductor and the topology shown in FIG. 12 is given purely by way of example. It will also be appreciated that the centre lines of these strip conductors 51L, 51R, 52L, 52R, 53L and 53R need not follow linear paths and may follow curved or other paths. It will also be appreciated that this technique may be employed in combination with the techniques hereinbefore described (i.e. tabs, notches, tapering and converging strip conductors).

FIG. 13 shows a conductor arrangement in which the centrelines of the strip conductors follow a curvilinear path. The strip conductors 61L, 61R, 62L, 62R, 63L, 63R may be of constant or varying width depending upon the requirements of a particular application. Notches or tabs may also be provided. This topology allows inductive coupling at crossings near the input ports (e.g. 63L and 62L; 63R and 61R) to be reduced whilst inductive coupling at crossings towards the centre (e.g. 61R and 63L; 63R and 62L) is increased. This topology may provide greater freedom to independently vary local capacitive and inductive coupling.

The various embodiments herein described provide a number of conductor arrangements which allow improved matching to be achieved, reduce insertion loss and return loss of a circulator. The topologies allow the mutual inductive and capacitive couplings to be altered somewhat independently to assist in optimising phase balance and coupling between ports. The topologies therefore enable improved transmission and impedance matching and isolation between circulator ports. It will be appreciated that the various techniques can be used separately or in combination.

Where in the foregoing description reference has been made to integers or components having known equivalents then such equivalents are herein incorporated as if individually set forth.

Although this invention has been described by way of example it is to be appreciated that improvements and/or modifications may be made thereto without departing from the scope of the invention as set out in the appended claims.

What is claimed is:

1. A conductor arrangement for a lumped element circulator including a plurality of crossing over strip conductors providing substantially different amounts of coupling between said strip conductors at selected individual cross-overs, wherein one or more of said strip conductors has a local width which varies between said selected cross-overs to provide different lumped coupling and alter the ratio between capacitive and inductive couplings at said selected cross-overs, and wherein no more than two of said strip conductors completely overlap at any one of said cross-overs.

2. A conductor arrangement as claimed in claim 1 wherein each conductor comprises a pair of said strip conductors.

3. A conductor arrangement as claimed in claim 1 wherein the strip conductors are arranged in an overlying spaced apart crossing over arrangement.

4. A conductor arrangement as claimed in claim 1 wherein said local width tapers from one end to the other end of one or more of said strip conductors.

5. A conductor arrangement as claimed in claim 4 wherein said one end is a distal end and said other end is a proximal end of one or more of said strip conductors.

6. A conductor arrangement as claimed in claim 5 wherein said one end is a proximal end and said other end is a distal end of one or more of said strip conductors.

7. A conductor arrangement as claimed in claim 4 wherein the angle of taper of the strip conductor is less than 10°.

8. A conductor arrangement as claimed in claim 4 wherein the angle of taper of the strip conductor is less than 5°.

9. A conductor arrangement as claimed in claim 4 wherein the angle of taper of the strip conductor is less than 2°.

10. A conductor arrangement as claimed in claim 1 wherein tabs are provided at regions where one or more of said strip conductors overlaps one or more other of said strip conductors.

11. A conductor arrangement as claimed in claim 1 wherein notches are provided at locations where one or more of said strip conductors overlaps with one or more other of said strip conductors.

12. A conductor arrangement as claimed in claim 1, wherein at least some of said strip conductors cross and the distance between at least some of said strip conductors at said cross-overs varies for each of said cross-overs.

13. A conductor arrangement as claimed in claim 1 wherein the strip conductors all have substantially the same shape.

14. A circulator including a conductor arrangement according to claim 1, a ferrite block adjacent the conductor arrangement and a means for generating a biasing magnetic field.

15. A conductor arrangement for a lumped element circulator including a plurality of crossing over conductors providing substantially different amounts of local coupling between portions of said conductors at selected cross-overs, wherein each of said conductors comprises a pair of strip conductors having centrelines which are disposed to each other at an angle of less than 10°, said strip conductors include a local width which tapers from a first proximal end to a second distal end, whereby the variation in local widths provides for different capacitive and inductive couplings at said selected cross-overs.

16. A conductor arrangement as claimed in claim 13 wherein said centrelines are disposed to each other at an angle less than 6°.

17. A conductor arrangement as claimed in claim 15 wherein said strip conductors are dimensioned so that, when in use in a circulator, the distal ends of the strip conductors join at a position beyond an adjacent ferrite block.

18. A conductor arrangement for a lumped element circulator including a plurality of crossing over strip conductors providing substantially different amounts of local coupling between said strip conductors at selected cross-overs, wherein at least one of said strip conductors has a transition along its centreline to provide different local lumped coupling at said selected cross-overs, and wherein no more than two of said strip conductors completely overlap at any one of said selected cross-overs.

19. A conductor arrangement as claimed in claim 18 wherein said transition is positioned adjacent an area where at least one of said strip conductors crosses over.

20. A conductor arrangement for a lumped element circulator including a plurality of crossing over strip conductors providing substantially different amounts of coupling between said strip conductors at selected cross-overs, wherein said strip conductors have centre lines which follow curvilinear paths and the arrangement is such as to provide different local lumped coupling at said selected cross-overs, and wherein no more than two of said strip conductors completely overlap at any one of said cross-overs.

21. A circulator comprising: a conductor arrangement, a ferrite block adjacent said conductor arrangement, and a means for generating a biasing magnetic field, wherein said conductor arrangement includes a plurality of crossing over conductors providing substantially different amounts of local coupling between portions of said conductors at selected cross-overs, wherein each of said conductors comprises a pair of strip conductors having centrelines which are disposed to each other at an angle of less than 10°; and wherein each pair of said strip conductors join at a point beyond said ferrite block, and wherein said strip conductors include a local width which tapers from a first proximal end to a second distal end, whereby the variation in local widths provides for different capacitive and inductive couplings at said selected cross-overs.

* * * * *